US012180977B2

(12) United States Patent
He

(10) Patent No.: US 12,180,977 B2
(45) Date of Patent: Dec. 31, 2024

(54) HIGH-SPEED BOOSTER FAN MODULE

(71) Applicant: Guangdong Wanyi Electronics Co., Ltd., Huizhou (CN)

(72) Inventor: Shunwan He, Dao (CN)

(73) Assignee: Guangdong Wanyi Electronics Co., Ltd., Huizhou (CN)

( * ) Notice: Subject to any disclaimer, the term of this patent is extended or adjusted under 35 U.S.C. 154(b) by 0 days.

(21) Appl. No.: 18/667,721

(22) Filed: May 17, 2024

(65) Prior Publication Data

US 2024/0301894 A1 Sep. 12, 2024

(30) Foreign Application Priority Data

Apr. 22, 2024 (CN) ..... 202420837253.3

(51) Int. Cl.
*F04D 19/00* (2006.01)
*F04D 29/54* (2006.01)

(52) U.S. Cl.
CPC ..... *F04D 29/544* (2013.01); *F04D 19/002* (2013.01); *F04D 19/007* (2013.01)

(58) Field of Classification Search
CPC ..... F04D 29/544; F04D 19/002
See application file for complete search history.

(56) References Cited

U.S. PATENT DOCUMENTS

| | | | | |
|---|---|---|---|---|
| 10,330,120 | B2 * | 6/2019 | Yang | F04D 29/4253 |
| 2020/0355199 | A1 | 11/2020 | Tsai et al. | |
| 2021/0018009 | A1 | 1/2021 | Hsieh et al. | |
| 2021/0277916 | A1 | 9/2021 | Ma et al. | |

FOREIGN PATENT DOCUMENTS

| | | | | |
|---|---|---|---|---|
| CN | 217029352 U | * | 7/2022 | F04D 25/08 |

* cited by examiner

*Primary Examiner* — Sabbir Hasan
(74) *Attorney, Agent, or Firm* — Hemisphere Law, PLLC; Zhigang Ma

(57) ABSTRACT

A high-speed booster fan module is provided, including an air duct, and an air inlet and an air outlet which are communicated to the air duct. In the present disclosure, the air flow achieves boosting and speeding up under cooperation between the air-driving fan blade group and the boosting mechanism; the air flow is collectively gathered by guidance of the flow guide member, thereby effectively improving the utilization rate of the air flow; and finally, the air flow is blown outwards after being secondarily boosted through the rectifying and boosting hood and subjected to turbulence removal, so that a wind speed and an air supply distance are greatly increased, an effect of silence and noise reduction is achieved.

11 Claims, 6 Drawing Sheets

HIGH-SPEED BOOSTER FAN MODULE

TECHNICAL FIELD

The present disclosure relates to the technical field of fans, and in particular, to a high-speed booster fan module.

BACKGROUND

When people go out or engage in outdoor activities in the hot summer, there may be no air conditioner. To facilitate cooling at any time, portable fans have emerged, which enjoy great popularity because they are convenient to carry and can be used at any time.

However, due to a small size of the portable fans, electric devices provided for the portables fan can only use low power. Therefore, the conventional portable fans may not be designed to have high wind strength, so that the portable fans have poor air blowing and cooling effects. Although some manufacturers have applied a structure of a traditional booster fan to this type of small-size portable fans to increase the wind speed to improve the cooling effect, such as Chinese patent (Np. CN217029352U), this does not consider the problem of a turbulent air flow. As a result, the portable fan is noisy during operation. This severely affects the customer experience and is not conductive to popularization and application of a product.

SUMMARY

The present disclosure aims to provide a high-speed booster fan module. An air flow achieves boosting and speeding up under cooperation between an air-driving fan blade group and a booster fan; the air flow is collectively gathered by guidance of an airflow direction guiding member, thereby effectively improving the utilization rate of the air flow; and finally, the air flow is blown outwards after being secondarily boosted through a rectifying and boosting hood and subjected to turbulence removal, so that this greatly increases a wind speed and an air supply distance, achieves an effect of silence and noise reduction, and solves the problems mentioned in the above background.

To achieve the above objectives, the present disclosure provides the following technical solutions: A high-speed booster fan module includes an air duct, and an air inlet and an air outlet which are communicated to the air duct, wherein an air-driving fan blade group is arranged in the air duct; after driving air at the air inlet to flow into the air duct, the air-driving fan blade group blows the air outwards from the air outlet; a booster fan is arranged at the air outlet; an airflow direction guiding member is arranged on one side of the booster fan away from the air-driving fan blade group; a rectifying and boosting hood is arranged on one side of the airflow direction guiding member away from the booster fan; the booster fan boosts the air flow output by the air-driving fan blade group; the airflow direction guiding member guides the air flow output from the booster fan, so that the air flow is blown out in a direction parallel to an axial direction; and the rectifying and boosting hood outwards blows the air flow output by the airflow direction guiding member after performing boosting and turbulence removal on the air flow.

Preferably, the booster fan includes a plurality of tangential wind boosting blades arranged at the air outlet; the plurality of tangential wind boosting blades are uniformly spaced and arranged around a circumferential direction of the air outlet to form a ring-like boosting air duct; the ring-like boosting air duct is coaxial with the air-driving fan blade group; the air-driving fan blade group includes a rotating seat and air-driving blades uniformly arranged on an outer circumferential wall surface of the rotating seat; a portion of an axial projection area of the air-driving blades that is located on an outer side of a projection area where the rotating seat is located overlaps a projection area of the ring-like boosting air duct.

Preferably, a surface of each of the tangential wind boosting blades facing an outer side of the air outlet is a windward surface, and a surface of one side of each of the air-driving blades facing the tangential wind boosting blade is an air-driving surface; in a rotation process of the air-driving fan blade group, in the same radial area, a curved surface where the windward surface is located is intersected with a curved surface where the air-driving surface is located; and an angle between the windward surface and the air-driving surface is $\theta1<90°$.

Preferably, an angle between the windward surface and a central axis of the air-driving fan blade group $\theta2$ satisfies: $30°<\theta2<60°$.

Preferably, the angle between the windward surface and the central axis of the air-driving fan blade group is $\theta2=45°$.

Preferably, the airflow direction guiding member includes a ring cover and a blade base coaxially arranged with the ring cover; a portion of a wall surface in a circumferential direction of the blade base extends outwards to form a flow guide blade; one end of the flow guide blade away from the blade base is connected to an inner wall of the ring cover; the flow guide blade is parallel to the central axis of the air-driving fan blade group; and an area where the flow guide blade is located covers the air outlet.

Preferably, a pressure relief protrusion is arranged on one side of the blade base away from the air outlet.

Preferably, the pressure relief protrusion is a hemisphere.

Preferably, the rectifying and boosting hood has openings at two ends; and an inner diameter of the rectifying and boosting hood radially decreases from the airflow direction guiding member to one side away from the airflow direction guiding member.

Preferably, an inner wall of the rectifying and boosting hood is in a circular-tube shape; an inner diameter of the rectifying and boosting hood is not less than an inner diameter of the airflow direction guiding member; and a length of the rectifying and boosting hood is not less than 15 mm.

Preferably, a motor base is arranged at an axis of the air outlet; the air-driving fan blade group includes a driving motor; and the driving motor is mounted on the motor base and is located in the air duct.

Compared with the prior art, the present disclosure has the beneficial effects below:

In the present disclosure, the air flow achieves boosting and speeding up under cooperation between the air-driving fan blade group and the booster fan; the air flow is collectively gathered by guidance of the airflow direction guiding member, thereby effectively improving the utilization rate of the air flow; and finally, the air flow is blown outwards after being secondarily boosted through the rectifying and boosting hood and subjected to turbulence removal, so that a wind speed and an air supply distance are greatly increased, an effect of silence and noise reduction is achieved.

Figure 1:
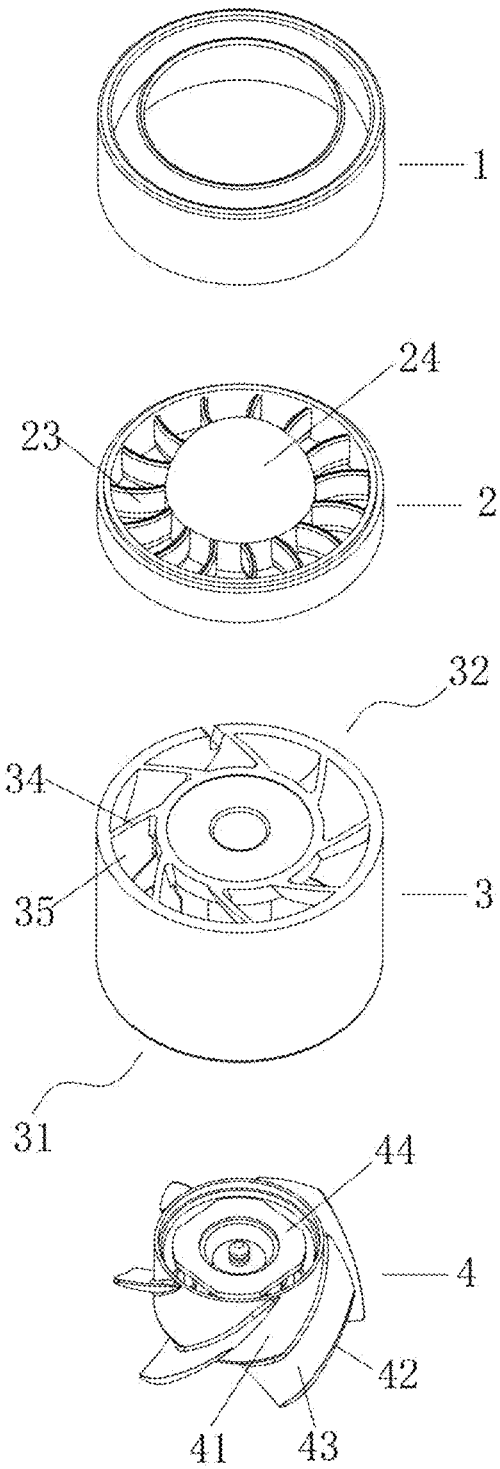
FIG. 1 is a structural exploded diagram I of the present disclosure.

In the drawings: 1: rectifying and boosting hood; 2: flow guide member; 21: ring cover; 22: blade base; 23: flow guide blade; 24: pressure relief protrusion; 3: air duct; 31: air inlet; 32: air outlet; 33: motor base; 34: tangential wind boosting blade; 35: windward surface; 4: air-driving fan blade group; 41: rotating seat; 42: air-driving blade; 43: air-driving surface; and 44: driving motor.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely some embodiments of the present disclosure, rather than all of the embodiments. All other embodiments obtained by a person of ordinary skill in the art based on the embodiments of the present disclosure without making creative efforts shall fall within the protection scope of the present disclosure.

Figure 2:
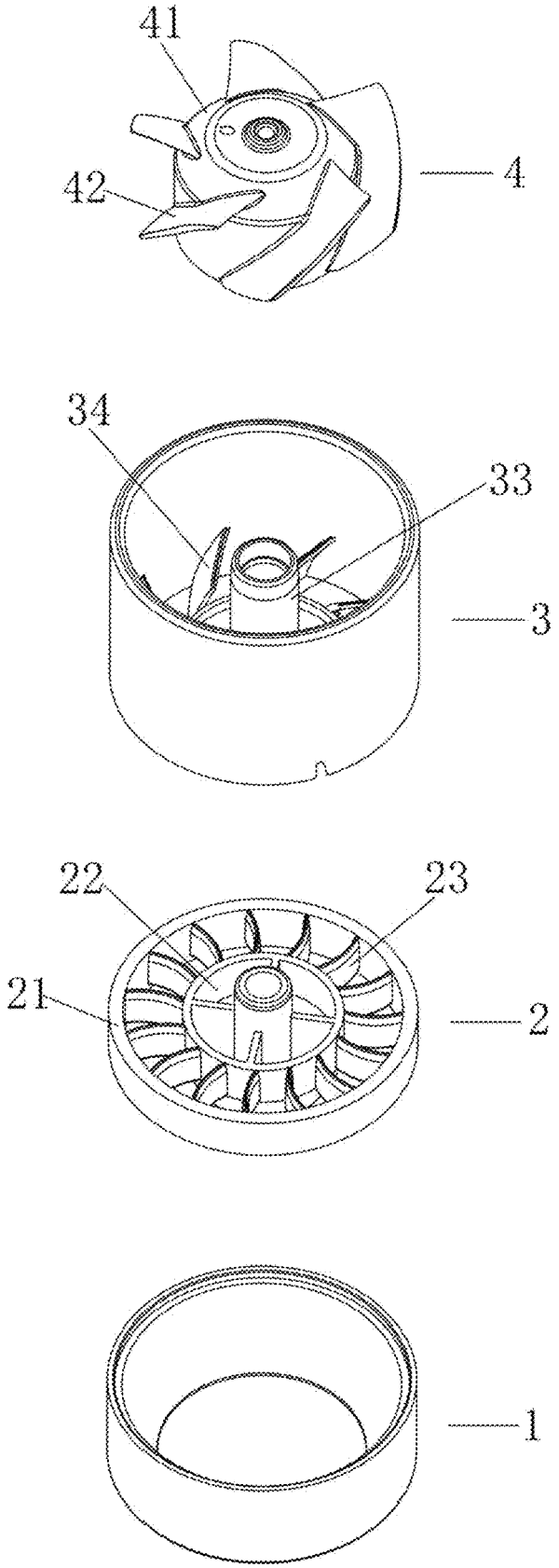
FIG. 2 is a structural exploded diagram II of the present disclosure.
Figure 3:
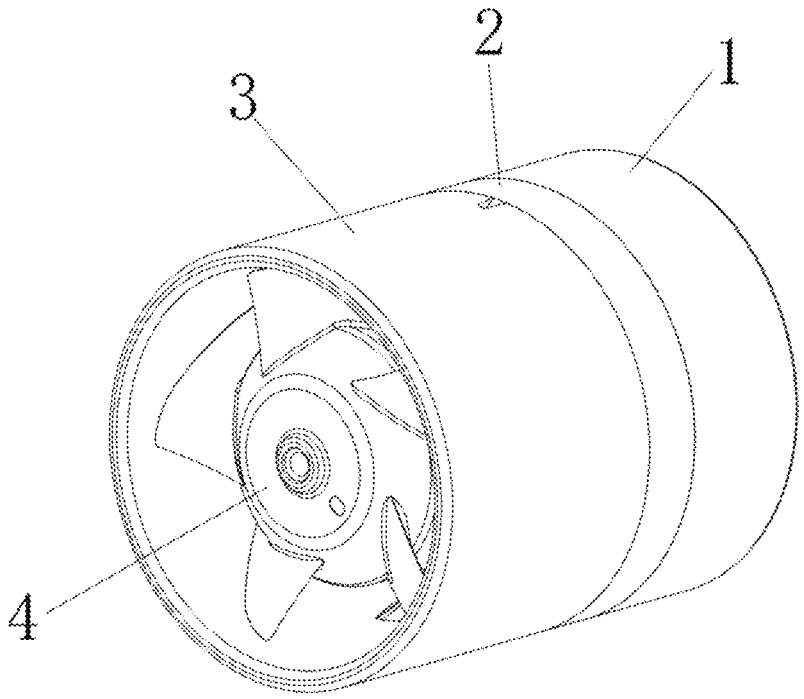
FIG. 3 is a schematic structural diagram I of the present disclosure.
Figure 4:
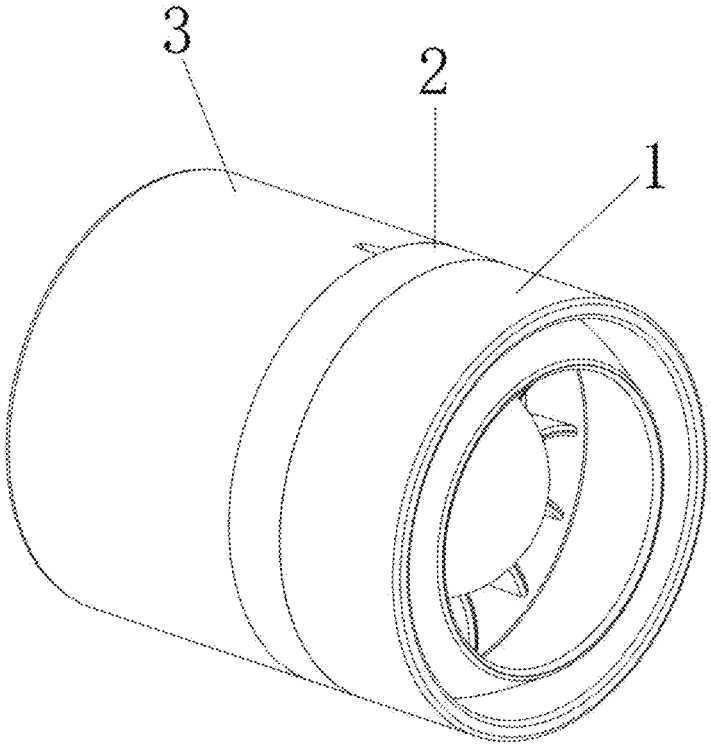
FIG. 4 is a schematic structural diagram II of the present disclosure.
Figure 5:
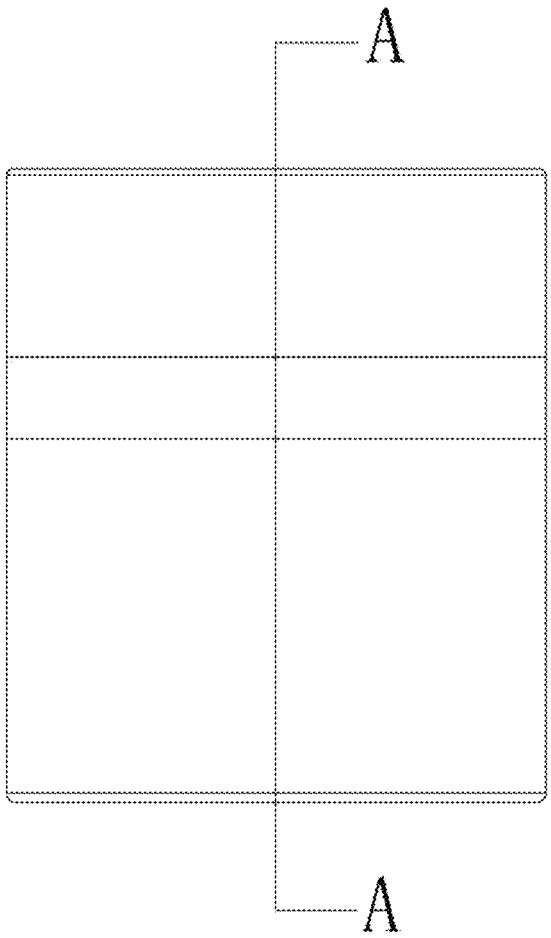
FIG. 5 is a schematic diagram of profile azimuth of the present disclosure.
Figure 6:
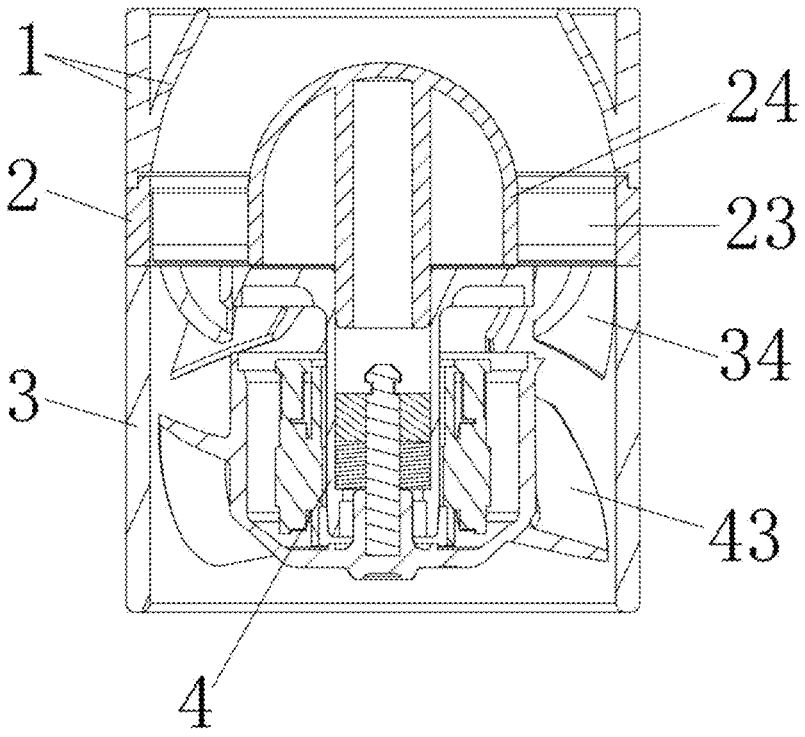
FIG. 6 is a cross-sectional view of A-A of the present disclosure.

Referring to FIG. 1 to FIG. 6, a high-speed booster fan module includes an air duct 3, and an air inlet 31 and an air outlet 32 which are communicated to the air duct 3, wherein an air-driving fan blade group 4 is arranged in the air duct 3; a motor base 33 is arranged at an axis of the air outlet 32; the air-driving fan blade group 4 includes a driving motor 44; the driving motor 44 is mounted on the motor base 33 and is located in the air duct 3; after driving air at the air inlet 31 to flow into the air duct 3, the air-driving fan blade group 4 blows the air outwards from the air outlet 32; a booster fan is arranged at the air outlet 32; an airflow direction guiding member 2 is arranged on one side of the booster fan away from the air-driving fan blade group 4; a rectifying and boosting hood 1 is arranged on one side of the airflow direction guiding member 2 away from the booster fan; the booster fan boosts the air flow output by the air-driving fan blade group 4; the airflow direction guiding member 2 guides the air flow output from the booster fan, so that the air flow is blown out in a direction parallel to an axial direction; and the rectifying and boosting hood 1 outwards blows the air flow output by the airflow direction guiding member 2 after performing boosting and turbulence removal on the air flow.

the booster fan includes a plurality of tangential wind boosting blades 34 arranged at the air outlet 32; the plurality of tangential wind boosting blades 34 are uniformly spaced and arranged around a circumferential direction of the air outlet 32 to form a ring-like boosting air duct; the ring-like boosting air duct is coaxial with the air-driving fan blade group 4; the air-driving fan blade group 4 includes a rotating seat 41 and air-driving blades 42 uniformly arranged on an outer circumferential wall surface of the rotating seat 41; a portion of an axial projection area of the air-driving blades 42 that is located on an outer side of a projection area where the rotating seat 41 is located overlaps a projection area of the ring-like boosting air duct. The overlapping of the protection areas can ensure that the air-driving volume of the air-driving blades 42 can be received by the windward surfaces of the tangential wind boosting blades 34 to the largest extent, thereby avoiding unnecessary turbulence in the air flow because surplus air acts on the air flow in other directions. A surface of each of the tangential wind boosting blades 34 facing an outer side of the air outlet 32 is a windward surface 35 and a surface of one side of each of the air-driving blades 42 facing the tangential wind boosting blade 34 is an air-driving surface 43; in a rotation process of the air-driving fan blade group 4, in the same radial area, a curved surface where the windward surface 35 is located is intersected with a curved surface where the air-driving surface 43 is located; and an angle between the windward surface 35 and the air-driving surface 43 is $\theta 1<90°$. Within this angle, the air-driving surface 43 and the windward surface 35 can achieve a boosting effect. In case of $\theta 1=45°$, the boosting effect is the best. The angle between the windward surface 35 and the central axis of the air-driving fan blade group 4 $\theta 2$ satisfies: $30°<\theta 2<60°$. When the angle between the windward surface 35 and the central axis of the air-driving fan blade group 4 is $\theta 2=45°$, a direction of an air flow reflected by the windward surface 35 is most parallel to the central axis of the air0driving fan blade group 4, namely, this is an angle where the axial air flowing efficiency is the highest.

the airflow direction guiding member 2 includes a ring cover 21 and a blade base 22 coaxially arranged with the ring cover 21; a portion of a wall surface in a circumferential direction of the blade base 22 extends outwards to form a flow guide blade 23; one end of the flow guide blade 23 away from the blade base 22 is connected to an inner wall of the ring cover 21; the flow guide blade 23 is parallel to the central axis of the air-driving fan blade group 4; and an area where the flow guide blade 23 is located covers the air outlet 32.

A pressure relief protrusion 24 is arranged on one side of the blade base 22 away from the air outlet 32. The pressure relief protrusion 24 is a hemisphere. When a high-speed air flow is blown out from gaps between the flow guide blades 23, a high-pressure vacuum area may be formed at the blade base 22 surrounded by the flow guide blades 23. Although the high-pressure vacuum area is formed due to the emptying of the high-speed air flow, the high-pressure vacuum area also generates a suction force on surrounding high-speed air flows. This suction force will cause a turbulence phenomenon in the high-speed air flow, thereby affecting the air flowing efficiency and increasing the noise of the air flow. Therefore, the arrangement of the pressure relief protrusion 24 can effectively minimize the vacuum area and avoid the adverse effects caused by the vacuum area to the largest extent.

The rectifying and boosting hood 1 has openings at two ends; and an inner diameter of the rectifying and boosting hood 1 radially decreases from the airflow direction guiding member 2 to one side away from the airflow direction guiding member 2. The radially decreasing rectifying and boosting hood 1 can further compress the air flow in a radial direction, which can not only increase the speed, but also eliminate a portion of the turbulence phenomenon by increasing a circumferential pressure of the air flow, thereby achieving the effect of turbulence elimination and silence. In another embodiment, an inner wall of the rectifying and boosting hood 1 is in a circular-tube shape; an inner diameter of the rectifying and boosting hood 1 is not less than an inner diameter of the airflow direction guiding member 2; and a length of the rectifying and boosting hood 1 is not less than 15 mm. A portion of the turbulence phenomenon can also be eliminated through the circular-tube-shaped rectifying and boosting hood 1 with a length coefficient, thereby achieving the effect of turbulence elimination and silence.

According to the high-speed booster fan module of the present disclosure, the driving motor 44 achieves air blowing independently under the control of a control circuit through an external control circuit and a power supply. The high-speed booster fan module can also be regarded as a functional module. When the high-speed booster fan module is cooperatively assembled with fan hardware equipment, the high-speed booster fan module can replace the air duct and the air-driving fan blade group of the conventional fan, so that the conventional fan is transformed into a high-speed booster fan module.

In conclusion: In the present disclosure, the air flow achieves boosting and speeding up under cooperation between the air-driving fan blade group 4 and the booster fan; the air flow is collectively gathered by guidance of the airflow direction guiding member 2, thereby effectively improving the utilization rate of the air flow; and finally, the air flow is blown outwards after being secondarily boosted through the rectifying and boosting hood 1 and subjected to turbulence removal, so that a wind speed and an air supply distance are greatly increased, an effect of silence and noise reduction is achieved.

It should be noted that in this document, relationship terms such as first and second are used solely to distinguish one entity or operation from another entity or operation without necessarily requiring or implying any actual such relationship or order between such entities or operations. Furthermore, the terms "include", "contain", or any other variation thereof, are intended to encompass a non-exclusive inclusion, such that a process, method, article, or device that includes a list of elements does not include only those elements but may include other elements not explicitly listed or inherent to such process, method, article, or device.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

What is claimed is:

1. A high-speed booster fan module, comprising an air duct (3), and an air inlet (31) and an air outlet (32) which are communicated to the air duct (3), wherein an air-driving fan blade group (4) is arranged in the air duct (3); after driving air at the air inlet (31) to flow into the air duct (3), the air-driving fan blade group (4) blows the air towards the air outlet (32); a booster fan is arranged at the air outlet (32); an airflow direction guiding member(2) is arranged on one side of the booster fan away from the air-driving fan blade group (4); a rectifying and boosting hood (1) is arranged on one side of the airflow direction guiding member(2) away from the booster fan; the booster fan boosts the air flow output by the air-driving fan blade group (4); the airflow direction guiding member(2) guides the air flow output from the booster fan, so that the air flow is blown out in a direction parallel to an axial direction; and the rectifying and boosting hood (1) outwards blows the air flow output by the airflow direction guiding member(2) after performing boosting and turbulence removal on the air flow.

2. The high-speed booster fan module according to claim 1, wherein the booster fan comprises a plurality of tangential wind boosting blades (34) arranged at the air outlet (32); the plurality of tangential wind boosting blades (34) are uniformly spaced and arranged around a circumferential direction of the air outlet (32) to form a ring-like boosting air duct; the ring-like boosting air duct is coaxial with the air-driving fan blade group (4); the air-driving fan blade group (4) comprises a rotating seat (41) and air-driving blades (42) uniformly arranged on an outer circumferential wall surface of the rotating seat (41); a portion of an axial projection area of the air-driving blades (42) that is located on an outer side of a projection area where the rotating seat (41) is located overlaps a projection area of the ring-line boosting air duct.

3. The high-speed booster fan module according to claim 2, wherein a surface of each of the tangential wind boosting blades (34) facing an outer side of the air outlet (32) is a windward surface (35), and a surface of one side of each of the air-driving blades (42) facing the tangential wind boosting blade (34) is an air-driving surface (43); in a rotation process of the air-driving fan blade group (4), in the same radial area, a curved surface where the windward surface (35) is located is intersected with a curved surface where the air-driving surface (43) is located; and an angle between the windward surface (35) and the air-driving surface (43) is $\theta 1<90°$.

4. The high-speed booster fan module according to claim 3, wherein an angle between the windward surface (35) and a central axis of the air-driving fan blade group (4) $\theta 2$ satisfies: $30°<\theta 2<60°$.

5. The high-speed booster fan module according to claim 4, wherein the angle between the windward surface (35) and the central axis of the air-driving fan blade group (4) is $\theta 2=45°$.

6. The high-speed booster fan module according to claim 1, wherein the airflow direction guiding member(2) comprises a ring cover (21) and a blade base (22) coaxially arranged with the ring cover (21); a portion of a wall surface in a circumferential direction of the blade base (22) extends outwards to form a flow guide blade (23); one end of the flow guide blade (23) away from the blade base (22) is connected to an inner wall of the ring cover (21); the flow guide blade (23) is parallel to the central axis of the air-driving fan blade group (4); and an area where the flow guide blade (23) is located covers the air outlet (32).

7. The high-speed booster fan module according to claim 6, wherein a pressure relief protrusion (24) is arranged on one side of the blade base (22) away from the air outlet (32).

8. The high-speed booster fan module according to claim 7, wherein the pressure relief protrusion (24) is a hemisphere.

9. The high-speed booster fan module according to claim 1, wherein the rectifying and boosting hood (1) has openings at two ends; and an inner diameter of the rectifying and boosting hood (1) radially decreases from the airflow direction guiding member(2) to one side away from the airflow direction guiding member(2).

10. The high-speed booster fan module according to claim 1, wherein an inner wall of the rectifying and boosting hood (1) is in a circular-tube shape; an inner diameter of the rectifying and boosting hood (1) is not less than an inner diameter of the airflow direction guiding member(2); and a length of the rectifying and boosting hood (1) is not less than 15 mm.

11. The high-speed booster fan module according to claim 1, wherein a motor base (33) is arranged at an axis of the air outlet (32); the air-driving fan blade group (4) comprises a driving motor (44); and the driving motor (44) is mounted on the motor base (33) and is located in the air duct (3).

* * * * *